United States Patent [19]

Kanne et al.

[11] Patent Number: 4,904,279

[45] **Date of Patent: * Feb. 27, 1990**

[54] HYDROCARBON FUEL COMPOSITION CONTAINING CARBONATE ADDITIVE

[75] Inventors: Diane D. Kanne, Yorba Linda; Ross Y. Iwamoto, Huntington Beach, both of Calif.

[73] Assignee: Union Oil Company of California, Brea, Calif.

[ * ] Notice: The portion of the term of this patent subsequent to Jan. 2, 2007 has been disclaimed.

[21] Appl. No.: 143,516

[22] Filed: Jan. 13, 1988

[51] Int. Cl.[4] ..... C10L 1/18

[52] U.S. Cl. ..... 44/70; 44/71

[58] Field of Search ..... 44/70, 71

[56] References Cited

U.S. PATENT DOCUMENTS

| | | | |
|---|---|---|---|
| 2,331,386 | 10/1943 | Gaylor | 44/70 |
| 2,844,450 | 7/1958 | Heisler et al. | 44/70 |
| 3,817,720 | 6/1974 | Moy et al. | 44/56 |
| 4,207,078 | 6/1980 | Sweeney et al. | 44/68 |
| 4,378,973 | 4/1983 | Sweeney | 44/56 |
| 4,380,455 | 4/1983 | Smith | 44/56 |
| 4,600,408 | 7/1986 | Jessup et al. | 44/70 |

OTHER PUBLICATIONS

Vogel's Textbook of Practical Organic Chemistry, Fourth Edition; Longman, London & New York, 1978, page 940.

SAE Technical Paper Series 821243 "The Effect of Hydrotreatment of Diesel Fuel Derived from Canadian Tar Sands on Particulate Exhaust Emissions"; D. L. Hilden et al., Toronto, Canada, 1982.

"Effects of Flame Temperature and Air-Fuel Mixing on Emission of Particulate Carbon from a Divided--Chamber Diesel Engine"; S. L. Plee et al., Warren, Mich.; pp. 423-429 in Reference entitled Particulate Carbon Formation During Combustion, Siglia and Smith, Eds; Plenum Press, New York, (1981).

SAE Technical Paper 811194, "Testing the Smoke Formation Properties of Compression Ignition Engine Fuels in Premixed Open Flames—A Promising Approach", H. O. Hardenberg, Stuttgart, Germany.

*Primary Examiner*—William R. Dixon, Jr.
*Assistant Examiner*—Ellen M. McAvoy
*Attorney, Agent, or Firm*—Arthur E. Oaks; Gregory F. Wirzbicki

[57] ABSTRACT

Hydrocarbon fuels heavier than gasoline, especially diesel fuel compositions, contain carbonate additives, preferably non-aromatic, metals-free carbonates, to reduce particulate emissions therefrom when combusted in an internal combustion engine.

29 Claims, No Drawings

HYDROCARBON FUEL COMPOSITION CONTAINING CARBONATE ADDITIVE

BACKGROUND OF THE INVENTION

This invention relates to organic additives for suppressing particulate emissions and hydrocarbon fuels containing the additives. These additives are useful for reducing soot, smoke and particulate emissions from hydrocarbon fuels.

The petroleum industry has encountered numerous problems in supplying hydrocarbon fuels, especially middle distillate fuels suitable for use in compression ignition and jet engines. One problem associated with combustion of hydrocarbon fuels in these engines is that they contribute materially to pollution of the atmosphere through soot, smoke and particulate emmissions in engine exhaust gases.

The particulate matter formed in combustion of hydrocarbon fuels, especially middle distillate fuels, such as diesel fuels, and residual fuels, such as non-distillate fuel oils, is commonly referred to as soot. When present in sufficient particle size and quantity, soot in engine, boiler or burner exhaust gases appears as a black smoke. Soot formation in exhaust gases is highly undesirable since it causes environmental pollution, engine design limitations, and possible health problems.

Diesel-type engines are well known for being highly durable and fuel efficient. Because of this durability and fuel efficiency, diesel-type engines have long been used in heavy-duty motor vehicles, such as trucks, buses and locomotives. Recently, however, the automotive industry is using diesel-type engines in passenger automobiles and light-duty trucks to achieve greater fuel economy and conserve gasoline. This increased use of diesel-type engines materially adds to pollution of the atmosphere through increased soot, smoke and particulate emissions from engine exhaust gases.

Several attempts have been made to reduce emissions from diesel-type engines through the use of additives to middle distillate fuels. For example, U.S. Pat. No. 3,817,720 relates to organic smoke suppressant additives and distillate hydrocarbon fuels containing the same. The preferred organic additives are ethers of hydroquinone. These compounds are ethers of phenolic-type compounds which contain two oxygen atoms attached to each phenyl moiety.

The suppression of particulate emissions from diesel engines is described in U.S. Pat. No. 4,240,802, which discloses the addition of a minor amount of a cyclopentadienyl manganese tricarbonyl and a lower alkyl or cycloalkyl nitrate to a hydrocarbon fuel. These compounds are described as useful in reducing particulate emissions of fuel oil.

It is an object of the present invention to provide liquid hydrocarbon fuel compositions heavier than gasoline having enhanced properties for suppressing particulate emissions.

Another object of the present invention is to provide a middle distillate fuel composition having properties for reducing soot and smoke emissions.

Other objects and advantages of the invention will be apparent from the following description.

SUMMARY OF THE INVENTION

The present invention resides in a hydrocarbon fuel composition having properties for suppressing emissions of particulates which comprises a liquid hydrocarbon fuel heavier than gasoline and a sufficient amount of at least one organic carbonate and at least one organic dicarbonate so as to reduce the amount of particulate emissions resulting from the combustion of the fuel.

DETAILED DESCRIPTION OF THE INVENTION

The present invention resides in a hydrocarbon fuel having properties for suppression of particulate emissions during combustion. In particular, the present invention relates to hydrocarbon fuel compositions comprising a hydrocarbon fuel heavier than gasoline containing at least two organically esterified carbonates added thereto to reduce the particulate emissions resulting from the combustion of the hydrocarbon fuel. In the composition of the present invention, at least one of the carbonate constituents is of the formula:

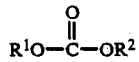

wherein $R^1$ and $R^2$ are the same or different monovalent organic radicals with between 1 and 10 carbon atoms, with the second carbonate compound being a dicarbonate having the general formula:

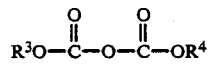

wherein $R^3$ and $R^4$ are the same or different monovalent organic radicals with between 1 and 10 carbon atoms.

Preferably $R^1$, $R^2$, $R^3$and $R^4$ are all metal-free, non-aromatic organic radicals. As used herein, the term "organic radical" means those radicals having at least one carbon atom. In the present invention, these may be the same or different monovalent aliphatic or alicyclic radicals with between 1 and 10 carbon atoms. More preferably they are the same or different substituted or unsubstituted (but preferably unsubstituted) alkyl, cycloalkyl, alkenyl, alkynyl, hydroxyalkyl, or nitroalkyl radicals having between 1 and 10 carbon atoms. Yet more preferably they are the same or different alkyl radicals having between 1 and 7 carbon atoms.

Examples of carbonate compounds suitable for use as the first additive component are dimethyl carbonate, diethyl carbonate, di-n-propyl carbonate, di-isopropyl carbonate, sec-butyl propyl carbonate, ethyl methyl carbonate, hexyl methyl carbonate, ethyl vinyl carbonate, methyl propynyl carbonate, cyclohexyl methyl carbonate, bis(2-methoxyethyl) carbonate, ethyl 2-nitro-butyl carbonate, 1-carbethoxyethyl methyl carbonate, methyl 2-tetrahydrofuranyl carbonate, acetyloxyethyl methyl carbonate, 3-hydroxybutyl methyl carbonate, 1,3-dioxolane-2-one-4-ylmethyl methyl carbonate and ethylene carbonate, with dimethyl carbonate being most preferred. Examples of dicarbonates suitable for use as the second additive component of the present invention are dialkyl dicarbonates such as dimethyl dicarbonate and diethyl dicarbonate, with dimethyl dicarbonate being most preferred.

One method by which these carbonates may be prepared is by the reaction of phosgene with alcohols. For example, low molecular weight carbonates are normally prepared by passing one equivalent of phosgene (carbonyl chloride) into a solution of greater than two equivalents of the appropriate alcohol in a non-reactive solvent, such as benzene, at low temperatures (0° to 65° C.). The reaction can be catalyzed by addition of a tertiary organic base or pyridine, both of which act as acid acceptors.

An alternative procedure is to react under reflux two equivalents of the appropriate alcohol with two equivalents of metallic sodium to form the sodium alkoxide. The alkoxide is diluted with a suitable solvent, such as benzene, and one equivalent of phosgene is slowly added at 0° C. to yield the carbonate.

Mixed carbonates are normally prepared by passing one equivalent of phosgene into a solution of one equivalent of the appropriate alcohol in benzene, or in another suitable solvent, and pyridine at low temperatures (0° to 10° C.). The chloroformic ester formed in this reaction is isolated and reacted with one equivalent of a second alcohol in the presence of a tertiary organic base or pyridine to form the mixed carbonate.

Higher molecular weight carbonates and those which contain other functional groups can be prepared by transesterification. This method involves reacting one equivalent of a low molecular weight carbonate, such as dimethyl carbonate, with greater than two equivalents of the appropriate alcohol in benzene, or toluene, and pyridine, or other base. The carbonate can be isolated by fractional distillation.

Generally, the composition of the invention is comprised of a hydrocarbon fuel and a sufficient amount of at least two organically esterified carbonates, as defined herein above, to reduce the particulate emissions from the combustion of the fuel. The combined dual carbonate additive is usually present from about 0.1 to about 49.9 weight percent, preferably from about 0.1 to about 20 weight percent, and more preferably from about 0.1 to about 10 weight percent based upon the total weight of fuel and carbonate. Typically, the carbonates, which are normally present as liquids, are admixed by dissolution into the hydrocarbon fuel. However, it has been found that dimethyl dicarbonate is essentially insoluble in hydrocarbon fuels heavier than gasoline and it is necessary to have an amount of an organically esterified carbonate such as dimethyl carbonate added to the fuel to act as a solubilizer for the dicarbonate. A preferred way of accomplishing such admixing is to prepared a concentrate, primarily or dimethyl carbonate and dimethyl dicarbonate, in a solvent which is miscible in the fuel. In the present invention, amounts between 0.5 and 10 parts, preferably between 0.5 and 5 parts and most preferably between 1 and 3 parts, by volume, of dicarbonate for each part of carbonate produce additive ratios which are particularly effective in reducing particulate emissions.

As stated above, hydrocarbon fuels useful for the practice of the present invention include liquid fuels heavier than gasoline, such as residual fuels, kerosene, jet fuels, heating oils, diesel fuels, light gas oil, and heavy gas oil, light cycle gas oils, heavy cycle gas oils, and vacuum gas oils. It should be noted that any liquid hydrocarbon fuel heavier than those in the gasoline boiling range in which the carbonate additive can be admixed to prepare a composition in accordance with the present invention is suitable for the purposes of the present invention. Preferably, the hydrocarbon fuel is a petroleum middle distillate fuel or residual fuel, and more preferably, diesel fuels or other middle distillates.

In addition the additives of this invention can be used to reduce particulate emissions from combustion of certain fuels not derived from petroleum, such as fuels derived from vegetable oils, or of liquid hydrocarbon fuels which contain alcohols. In hydrocarbon fuels containing alcohol, the duel carbonate additives of the present invention usually exhibit the additional advantage of acting as cosolvents, allowing for miscibility of more alcohol in the hydrocarbon-carbonate mixture than if the carbonates were not present.

The most preferred distillate hydrocarbon stocks useful for preparing the fuel oil compositions of this invention are generally classified as petroleum middle distillates boiling in the range of 350° F. to 700° F. and have cloud points usually from about −78° F. to about 45° F. The hydrocarbon stock can comprise straight run, or cracked gas oil, or a blend in any proportion of straight run and thermally and/or catalytically cracked distillates, etc. The most common petroleum middle distillate fuels are kerosene, diesel fuels, aviation fuels, and some heating oils. Residual fuels, which are also a preferred hydrocarbon fuel, include non-distillate heating oils, such as Grades No. 5 and 6 fuel oils.

A typical heating oil specification calls for a 10 percent ASTM D-86 distillation point no higher than about 420° F., a 50 percent point no higher than about 520° F. and a 90 percent point of at least 540° F., and no higher than about 640° F. to 650° F., although some specifications set the 90 percent point as high as 675° F.

A typical specification for a diesel fuel includes a minimum flash point of 100° F., a boiling point range of from about 300° F. to about 700° F., and maximum 90 percent distillation point (ASTM D-86) of 640° F., i.e., 90 percent by volume boils below 640° F. (See ASTM Designation 975.)

The hydrocarbon fuel composition of the present invention may also comprise any of the known conventional additives, such as cetane improvers, dyes, oxidation inhibitors, etc.

The invention further provides a concentrate for use in the liquid fuels disclosed hereinabove comprising: (a) usually from about 0.1 to 99.9 weight percent, of the hereinabove described carbonate additives and (b) the balance of a solvent for the carbonates that is miscible and/or capable of dissolving in the fuel.

Non-limiting examples of suitable solvents are hydrocarbon fuels heavier than gasoline, such as kerosene, diesel fuel, and the like, and hydrocarbon solvents such as hexane and heptane, ether solvents, and mixtures of hydrocarbon solvents, or other organic solvents. Preferably, however, the concentrate is either an undiluted carbonate additive or a solution comprising (a) between about 10 and 50 weight percent of the hereinabove described carbonate additives and (b) a mixture in any proportions of hydrocarbon solvents selected from the group consisting of hexane, heptane, ether solvents, kerosene and diesel fuels.

The invention is further described in the following Examples, which are illustrative and not intended to be construed as limiting the scope of the invention as defined in the claims.

EXAMPLE 1

In a series of 100 ml graduated cylinders respectively containing 91, 95, 99 and 99.5 ml of a commercially available No. 2 diesel fuel were mixed with sufficient dimethyl carbonate to bring the final volume to 100 ml. Each of these mixtures was then stirred at room temperature in a beaker for about 30 minutes and then allowed to sit for an additional 30 minutes. Solubility was determined by a standard procedure in which a specified mixture forms a homogeneous liquid (i.e., a single layer) having no cloudiness. (See Vogels Textbook of Practical Organic Chemistry, Fourth Edition, Longman, London, 1978, page 940). Examination of these samples showed that, in each case, the dimethyl dicarbonate had settled out and was insoluble in diesel fuel to any practical extent.

EXAMPLE 2

The procedure of Example 1 was repeated but with a 1:1 mixture, by volume, of dimethyl carbonate and dimethyl carbonate being used. In each case, the mixture fully dissolved in the diesel fuel.

Examples 1 and 2 show that, while dimethyl dicarbonate is essentially insoluble in diesel fuel, dimethyl carbonate can act as a "cosolvent" therefor so as to cause the solution therein of a significant amount of dimethyl dicarbonate.

EXAMPLES 3–21

The following examples demonstrate the reduction of particulate emissions from the combustion of a gaseous hydrocarbon fuel, propane, containing dimethyl dicarbonate, dimethyl carbonate and 1:1 and 3:1 mixtures of dimethyl dicarbonate and dimethyl carbonate. The procedure for measuring particulate emissions involves combusting the propane in a laminar diffusion flame which is generated and stabilized using a 1.9 centimeter (cm) diameter capillary burner. The burner consists of three concentrically positioned stainless steel tubes which have respective inner diameters of 0.4 cm, 1.1 cm and 1.8 cm. Positioned within and between these tubes are stainless steel hypodermic tubes (0.84 millimeters (mm)). Propane, the desired amount of carbonate additive, and nitrogen are provided through the central tube with oxygen and nitrogen provided through the middle tube. Through the outer concentric tube, a shroud of nitrogen is provided to shield the flame from atmospheric oxygen. The oxygen, nitrogen, and propane are meters into the tubes of the burner through calibrated glass rotometers. The total flow rates of oxygen and nitrogen for all of the examples are 0.96 and 2.35 liters per minute (1/min), respectively. Particulate emission rates are measured as a function of the propane flow rate as listed below in Table 1 for each example. The carbonate additive is added through a 90° "pneumatic" nebulizer and monitored with a motorized syringe pump. The burner is enclosed in a circular cross-sectional quartz chimney (7 cm inner diameter by 45 cm long) which is fitted with a filter holder for collecting particulate emissions. Test durations were 5 minutes for each example shown in Table 1. Fuel was also run using no additive to provide a comparison with the present invention.

While the following examples demonstrate the invention using propane as the hydrocarbon fuel, they also illustrate that under combustion conditions which result in formation of particulates from hydrocarbon fuels, such as middle distillates, the amount of particulates can be reduced by adding the carbonate additives of the present invention to the fuel before combustion. Therefore, the invention is advantageously employed with fuels exhibiting relatively high particulate emissions, such as middle distillate fuels. Thus, while the invention finds use in reducing particulate emissions from the combustion of any hydrocarbon fuel, it is particularly preferable when the fuel is a middle distillate fuel (i.e. diesel fuel).

The particulate emission rates are measured by drawing the exhaust out of the chimney through a fluoro-carbon-coated glass fiber filter using a rotary vane vacuum pump. The weight of particulate matter collected on the filter is determined by weighing the filter before and after the test and subtracting the former from the latter.

The results of the particulate emissions measurement for each example are listed in Table 1.

TABLE 1

| | Experiment No. | Propane Flow Rate (liters/min) | Additive Flow Rate (microliters/min) | Mean Particulate Emission Rate (mg/min) | No. Of Tests | Particulate Reduction (percent) |
|---|---|---|---|---|---|---|
| Dimethyl Dicarbonate | 3 | 0.23 | 0 | 12.12 | 8 | 0 |
| | 4 | 0.23 | 13 | 11.80 | 5 | 2.6 |
| | 5 | 0.25 | 0 | 10.92 | 8 | 0 |
| | 6 | 0.25 | 13 | 10.66 | 5 | 2.4 |
| 1:1 Dimethyl Carbonate to Dimethyl Dicarbonate volume ratio | 7 | 0.23 | 0 | 11.89 | 15 | 0 |
| | 8 | 0.23 | 26 | 11.41 | 4 | 4.1 |
| | 9 | 0.25 | 0 | 10.96 | 18 | 0 |
| | 10 | 0.25 | 26 | 10.35 | 4 | 5.6 |
| 3:1 Dimethyl Carbonate to Dimethyl Dicarbonate volume ratio | 11 | 0.23 | 0 | 11.89 | 15 | 0 |
| | 12 | 0.23 | 26 | 11.28 | 3 | 5.1 |
| | 13 | 0.25 | 0 | 10.96 | 18 | 0 |
| | 14 | 0.25 | 26 | 10.14 | 3 | 7.5 |
| Dimethyl Carbonate | 15 | 0.23 | 0 | 11.73 | 24 | 0 |
| | 16 | 0.23 | 13 | 11.34 | 1 | 3.3 |
| | 17 | 0.25 | 0 | 11.18 | 8 | 0 |
| | 18 | 0.25 | 13 | 10.92 | 5 | 2.3 |
| | 19 | 0.23 | 26 | 10.89 | 12 | 7.1 |
| | 20 | 0.25 | 0 | 11.18 | 26 | 0 |
| | 21 | 0.25 | 26 | 10.45 | 12 | 6.4 |

In evaluating these examples, note that all of the tests conducted with dimethyl dicarbonate alone (examples 3–6) used an additive flow rate of 13 microliters per minute rather than the 26 microliters per minute used with most of the other additive additions. This was necessary to keep the additive from dropping out of the fuel stream before entering the flame. The tests were also conducted using two propane fuel flow rates, 0.23 and 0.26 liters per minute, the former representing a typical fuel-rich combustion environment and the latter representing a very fuel-rich environment. These examples clearly show that the use of a dual carbonate additive of the present invention will effect a significant reduction in particulate emissions as compared to fuels run without any additive and that the best results were obtained with the 3:1 dicarbonate/carbonate mixture of the present invention.

Obviously, many modifications and variations of the invention, as hereinbefore set forth, may be made without departing from the spirit and scope thereof. For example, although the invention is primarily directed to reduction of particulate emissions from the combustion liquid hydrocarbon fuels heavier than gasoline, it can be seen that the invention can also be advantageously employed with gaseous hydrocarbon fuels such as methane, ethane, propane, acetylene, or natural gas. Also, although reference has been made to petroleum middle distillates as a preferred fuel, the invention may also be used successfully with other middle distillates, such as diesel fuels, aviation fuels, etc., which are derived from shale coal or tar sands. Accordingly, it is intended in the invention to enhance these and all such alternatives, modifications, and variations as fall within the spirit and scope of the appended claims.

What is claimed is:

1. A composition comprising:

(a) a particulate emissions reducing amount of an additive comprising at least two carbonates, a first of said carbonates having the general formula:

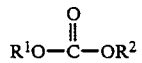

wherein $R_1$ and $R_2$ are the same or different monovalent non-aromatic organic radicals with between 1 and 10 carbon atoms, with the second carbonate compound being a dicarbonate having the general formula:

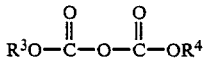

wherein $R_3$ and $R_4$ are the same or different monovalent non-aromatic organic radicals with between 1 and 10 carbon atoms, said dicarbonate being present in an amount between 0.5 and 10 parts, by volume, for each part of said first carbonate; and (b) a liquid hydrocarbon fuel heavier than gasoline, said carbonate additive constituting between about 0.1 and about 49.9 weight percent of the total weight of the composition.

2. The composition of claim 1 wherein the total amount of carbonate additive is from about 0.1 to about 20 weight percent of the total weight of the composition.

3. The composition of claim 1 wherein the total amount of carbonate additive is from about 0.1 to about 10 weight percent of the total weight of the composition.

4. The composition of claim 1 wherein the volume ratio of dicarbonate to carbonate is between 0.1 and 5.

5. The composition of claim 1 wherein the volume ratio of dicarbonate to carbonate is between 1 and 3.

6. The composition of claim 1 wherein $R^1$, $R^2$, $R^3$ and $R^4$ are the same or different, substituted or unsubstituted, monovalent alkyl, cycloalkyl, alkenyl, alkynyl, hydroxyalkyl, alkoxyalkyl, nitroalkyl, a cyloxyalkyl, carbalkoxyalkyl, carbalkoxy, and 1,3-dioxolane-2-one-4yalkyl radicals comprising from 1 to about 10 carbon atoms.

7. The composition of claim 6 wherein $R^1$, $R^2$, $R^3$ and $R^4$ are the same or different monovalent radicals selected from the group consisting of monovalent alkyl, alkoxyalkyl, carbalkoxyalkyl and carbalkoxy radicals comprising from 1 to about 7 carbon atoms.

8. The composition of claim 7 wherein $R^1$, $R^2$, $R^3$ and $R^4$ are monovalent alkyl radicals.

9. The composition of claim 1 wherein the liquid hydrocarbon fuel is selected from the group consisting of kerosene, jet fuel, heating oil, diesel fuel, light gas oil, heavy gas oil, light cycle gas oil, heavy cycle gas oil, and vacuum gas oil.

10. The composition of claim 1 wherein the liquid hydrocarbon fuel is diesel fuel.

11. A composition comprising:

(a) a middle distillate hydrocarbon fuel; and (b) from about 0.1 to about 49.9 weight percent of a metals-free and non-aromatic carbonate additive based on the weight of the hydrocarbon fuel, said additive comprising at least two carbonates, the first of said carbonates having the general formula:

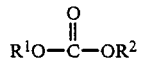

wherein $R^1$ and $R^2$ are the same or different monovalent non-aromatic organic radicals with between 1 and 10 carbon atoms, with the second carbonate compound being a dicarbonate having the general formula:

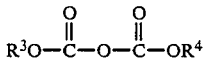

wherein $R^3$ and $R^4$ are the same or different monovalent non-aromatic organic radicals with between 1 and 10 carbon atoms, said dicarbonate being present in an amount between 0.5 and 10 parts, by volume, for each part of said first carbonate, the composition having the property of releasing fewer particulates upon combustion than would the fuel without the additive.

12. The composition of claim 11 wherein $R^1$,R2, $R^3$ and $R^4$ are the same or different monovalent aliphatic or alicyclic radicals comprising from 1 to about 10 carbon atoms.

13. The composition of claim 12 wherein $R^1$,$R^2$, $R^3$ and $R^4$ are the same or different monovalent alkyl radicals comprising from 1 to about 7 carbon atoms.

14. The composition of claim 13 wherein the total amount of carbonate additive is from about 0.1 to about 5 weight percent of the total weight of the hydrocarbon fuel and the carbonate additive and the discarbonate is present in an amount between 0.1 to about 5 parts, by volume for each part of carbonate in said additive.

15. The composition of claim 11 wherein the middle distillate fuel is diesel fuel.

16. A method for reducing the particulate emissions from combustion of liquid hydrocarbon fuels heavier than gasoline comprising combusting a mixture containing the hydrocarbon fuel and from about 0.1 to about 49.9 weight percent of a metals-free and non-aromatic carbonate additive based on the weight of the hydrocarbon fuel, said additive comprising at least two carbonates, the first of said carbonates having the general formula:

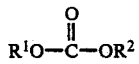

wherein $R^1$ and $R^2$ are the same or different monovalent non-aromatic organic radicals with between 1 and 10 carbon atoms, with the second carbonate compound being a dicarbonate having the general formula:

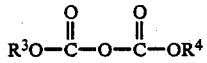

wherein $R^3$ and $R^4$ are the same or different monovalent non-aromtic organic radicals with between 1 and 10 carbon atoms, said dicarbonate being present in an amount between 0.5 and 10 parts, by volume, for each part of said first carbonate.

17. The method of claim 16 wherein the total amount of carbonate additive admixed with the hydrocarbon fuel is in an amount from about 0.1 to about 5 weight percent of the total weight of the hydrocarbon fuel and carbonate additive, and the dicarbonate is present in an amount between 1 to about 3 parts, for each part of carbonate in said additive.

18. The method of claim 16 wherein $R^1$,$R^2$, $RR^3$ and $R^4$ are the same or different monovalent aliphatic or alicyclic radicals comprising from 1 to about 10 carbon atoms.

19. The method of claim 16 where the first carbonate is dimethyl carbonate and the second carbonate is dimethyl dicarbonate.

20. The method of claim 16 wherein the hydrocarbon fuel is diesel fuel.

21. A composition comprising:

(a) a particulate reducing amount of a metals-free non-aromatic particulate emissions suppression additive consisting essentially of at least two metals-free and non-aromatic carbonates, the first of said carbonates having the general formula:

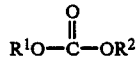

wherein $R^1$ and $R^2$ are the same or different monovalent non-aromatic organic radicals with between 1 and 10 carbon atoms, with the second carbonate compound being a dicarbonate having the general formula:

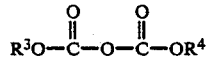

wherein $R^3$ and $R^4$ are the same or different monovalent non-aromatic organic radicals with between 1 and 10 carbon atoms; and (b) a liquid hydrocarbon fuel which, if combusted without said additive, would release a substantial proportion of particulates.

22. A composition comprising:

(a) between 0.1 and 5 weight percent of a metals-free, non-aromatic particulate emission suppression additive consisting essentially of at least two metals-free and non-aromatic carbonates, the first of said carbonates having the general formula:

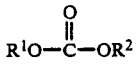

wherein $R^1$ and $R^2$ are the same or different monovalent non-aromatic organic radicals with between 1 and 10 carbon atoms, with the second carbonate compound being a dicarbonate present in an amount between 0.5 part and 5 parts, by volume, for each part of said first carbonate and having the general formula:

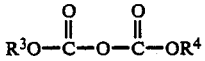

wherein $R^3$ and $R^4$ are the same or different monovalent non-aromatic organic radicals with between 1 and 10 carbon atoms; and (b) a liquid diesel fuel, said carbonate additive constituting between about 0.1 and about 49.9 weight percent of the total weight of the composition.

23. The composition of claim 22 wherein the volume ratio of dicarbonate to carbonate is between 1 and 3.

24. The composition of claim 22 wherein $R^1$, $R^2$, $R^3$ and $R^4$ are the same or different monovalent radicals selected from the group consisting of monovalent alkyl, alkoxyalkyl, carbalkoxyalkyl and carbalkoxy radicals comprising from 1 to about 7 carbon atoms.

25. The composition of claim 24 wherein $R^1$, $R^2$, $R^3$ and $R^4$ are monovalent alkyl radicals.

26. The composition of claim 22 where the first carbonate is dimethyl carbonate and the second carbonate is dimethyl dicarbonate.

27. A concentrate comprising:

(a) a mixture comprising at least two carbonates, the first of said carbonates having the general formula:

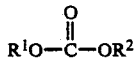

wherein $R^1$ and $R^2$ are the same or different monovalent non-aromatic organic radicals with between 1 and 10 carbon atoms, with the second carbonate being a dicarbonate having the general formula:

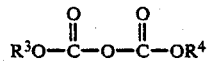

wherein $R^3$ and $R^4$ are the same or different monovalent non-aromatic organic radicals with between 1 and 10 carbon atoms, said dicarbonate being present in an amount between 0.5 and 10 parts, by volume, for each part of said first carbonate; in a concentration of between about 0.1 and about 99.9 weight percent of the concentrate; and (b) a solvent for the carbonates, the solvent being miscible in liquid hydrocarbon fuels heavier than gasoline.

28. The concentrate of claim 27 wherein the concentration of the carbonates is between about 10 and 50 weight percent thereof.

29. The concentrate of claim 27 wherein the carbonates are metals-free and non-aromatic.

* * * * *

UNITED STATES PATENT AND TRADEMARK OFFICE

CERTIFICATE OF CORRECTION

PATENT NO. : 4,904,279

DATED : February 27, 1990

INVENTOR(S) : Diane D. Kanne and Ross Y. Iwamoto

It is certified that error appears in the above-identified patent and that said Letters Patent is hereby corrected as shown below:

In column 7, line 33, after "wherein", change $R_1$ to -- $R^1$ --, and change $R_2$ to -- $R^2$ --.

In column 7, line 42, after "wherein", change $R_3$ to -- $R^3$ --, and change $R_4$ to -- $R^4$ --.

Signed and Sealed this

Fourth Day of December, 1990

*Attest:*

*Attesting Officer*

HARRY F. MANBECK, JR.

*Commissioner of Patents and Trademarks*